United States Patent [19]

Furukawa et al.

[11] 4,226,283

[45] Oct. 7, 1980

[54] MULTITUBULAR HEAT EXCHANGER

[75] Inventors: Masahiro Furukawa; Tamotsu Yamane, both of Hitachi, Japan

[73] Assignee: Hitachi, Ltd., Japan

[21] Appl. No.: 823,655

[22] Filed: Aug. 11, 1977

[30] Foreign Application Priority Data

Aug. 27, 1976 [JP] Japan ..... 51-101574

[51] Int. Cl.[2] ..... F28B 9/10; F28F 9/22

[52] U.S. Cl. ..... 165/114; 122/441; 165/134 R; 165/160; 165/163

[58] Field of Search ..... 122/32, 441; 165/110 D, 165/111 D, 114, 134, 160, 161, 163, 176

[56] References Cited

U.S. PATENT DOCUMENTS

| | | | |
|---|---|---|---|
| 1,746,716 | 6/1930 | Ehrhart | 165/112 |
| 2,180,840 | 11/1939 | Tuley et al. | 165/114 |
| 3,349,841 | 10/1967 | Stoker | 165/114 |
| 3,795,273 | 3/1974 | Brigida et al. | 122/441 |
| 3,938,588 | 2/1976 | Coit et al. | 122/441 |

*Primary Examiner*—Sheldon Jay Richter
*Attorney, Agent, or Firm*—Craig & Antonelli

[57] ABSTRACT

A multitubular heat exchanger mainly used in thermal and nuclear power plants having a plurality of tube bundles located within a shell and including a large number of U-shaped heat transfer tubes for permitting a medium to be heated to flow therethrough, and a vent tube interposed between the tube bundles and arranged in the longitudinal direction of the shell, further includes at least one flow guide plate with or without at least one slit disposed in or near the outer marginal portion of one of the tube bundles for inducing streams of a heating medium to flow toward the vent tube. The provision of the guide plate with or without the slit has the effect of moving a heating medium stagnating zone, which has hitherto been located in one of the tube bundles, to a position which is in the vicinity of the vent tube to thereby prevent corrosion of the heat transfer tubes by noncondensable gas.

12 Claims, 21 Drawing Figures

MULTITUBULAR HEAT EXCHANGER

LIST FOR PRIOR ART REFERENCES (37 CFR 1.56(a))

The following reference is cited to show the state of art:

"Operational Experience with Heat Exchangers in Nuclear Power Stations with Light Water Reactors" by H. BASCHEK and E. KOCOUREK, September 1975/COMBUSTION, page 14–23.

BACKGROUND OF THE INVENTION

This invention relates to a multitubular heat exchanger mainly used in thermal and nuclear power plants.

Heat exchangers of this type of the prior art generally comprise a shell, a heating medium inlet formed in the shell, a plurality of tube bundles located within the shell and including a large number of U-shaped heat transfer tubes for permitting a medium to be heated to flow therethrough so that heat exchange may take place between the medium to be heated and a heating medium, an inlet for the medium to be heated and an outlet for the heated medium formed in the shell at one end portion thereof and each communicating with the U-shaped heat transfer tubes at one end portion thereof, and a vent tube interposed between the tube bundles and arranged in the longitudinal direction of the shell for removing noncondensable gas from the interior of the shell. In the heat exchangers constructed as aforesaid, the ratio of the amount of heat exchanged in the tube bundle near the inlet for the medium to be heated to the amount of heat exchanged in the tube bundle near the heated medium outlet has hitherto been 15:1, and this has caused the terminal ends of streams of the heating medium to be concentrated in the middle portion of the tube bundle near the inlet for the medium to be heated. The result of this has been that a heating medium and noncondensable gas stagnating zone is created in this portion, so that it has been impossible to remove noncondensable gas satisfactorily through the vent tube interposed between the tube bundles located near the inlet for the medium to be heated and the tube bundle located near the heated medium outlet. Thus heat exchangers of this type of the prior art have had the disadvantage of the heat transfer tubes corroding in the heating medium and noncondensable gas stagnating zone.

SUMMARY OF THE INVENTION

Accordingly, the present invention has as its object the provision of a multitubular heat exchanger which is capable of preventing the corrosion of the heat transfer tubes due to the stagnation of the streams of a heating medium and which has a superb performance.

According to the invention, there is provided a multitubular heat exchanger comprising a shell, a heating medium inlet formed in the shell, a plurality of tube bundles located within the shell and including a large number of U-shaped heat transfer tubes for permitting a medium to be heated to flow therethrough so that heat exchange may take place between the medium to be heated and a heating medium introduced into the interior of the shell through the heating medium inlet, and a vent tube interposed between the tube bundles and arranged in the longitudinal direction of the shell for removing noncondensable gas from the interior of the shell, wherein the improvement comprises at least one flow guide plate located on the outer periphery side of one of the tube bundles for inducing streams of the heating medium flowing between the shell and the tube bundles to pass on to the vent tube.

According to the invention, there is also provided a multitubular heat exchanger of the type described, wherein at least one slit cooperating with said at least one guide flow plate is provided in a manner to open in an outer marginal portion of said one of the tube bundles and extending through the interior of the tube bundle toward the vent tube.

DESCRIPTION OF THE PREFERRED EMBODIMENTS

Figure 1A:
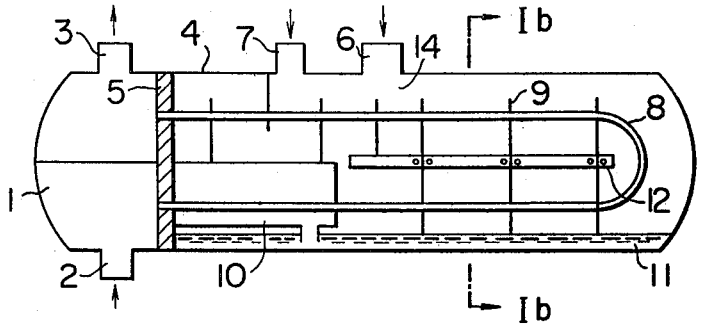
FIG. 1a PRIOR ART
FIG. 1*a* is a sectional view of a twin shell type multitubular heat exchanger of the prior art.
Figure 1B:
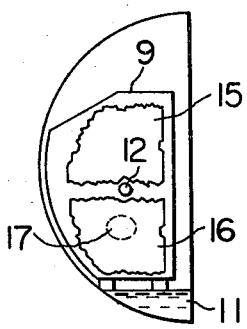
FIG. 1b PRIOR ART
FIG. 1*b* is a sectional view showing one of the shells along the line I*b*—I*b* of FIG. 1*a;*

FIGS. 1*a* and 1*b* show a twin shell type multitubular heating exchanger of the prior art, wherein heating steam from a turbine and drain from a high pressure side heat exchanger are introduced through a steam inlet port 6 and a drain inlet port 7, respectively, formed in a shell 4 into the interior of the shell 4. The steam and drain flow through a steam passage 14 in the upper portion of the interior of the shell 4, and through heat exchanging sections (tube bundles) 15 and 16 defined by tube support plates 9 to impart heat to feedwater flowing through heat transfer tubes 8 of the tube bundles 15 and 16. Thereafter the steam is condensed into water which collects in the bottom portion of the interior of the shell. The feedwater flows through a feedwater inlet 2 into a water box 1, flows through the heat transfer tubes 8, and is discharged through a feedwater outlet 3.

5 is a tube plate, 10 a drain cooler and 11 water (drain). The water or drain collecting in the bottom portion of the interior of the shell 4 is cooled in the drain cooler and discharged through an outlet, not shown, so as to keep constant the water level in the bottom portion of the shell 4. The drain outlet is connected to another device of lower pressure than this heat exchanger.

Figure 2:
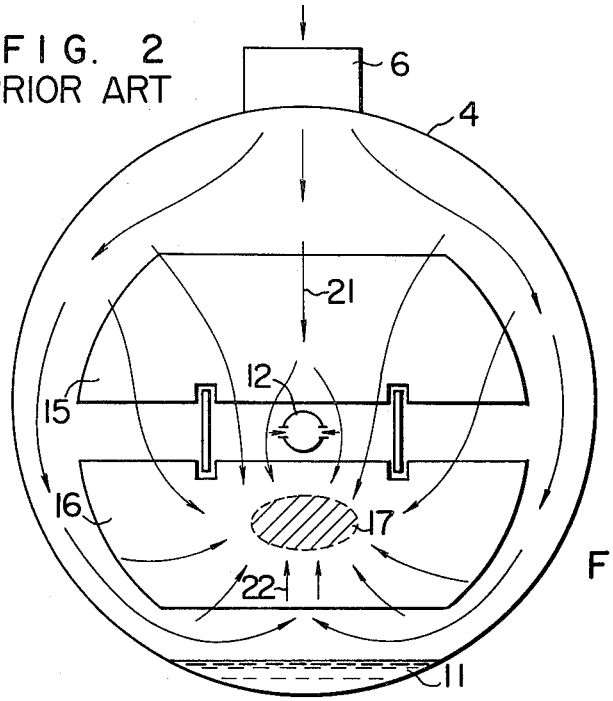
FIG. 2 PRIOR ART
FIG. 2 is a view in explanation of the operation of the heat exchanger of the prior art.

In the heat exchanger of the prior art constructed as aforesaid, the steam introduced through the steam inlet 6 flows in streams as shown at 21 and 22 in FIG. 2. The tube bundle 16 near the feedwater inlet 2 and the tube bundle 15 near the feedwater outlet 3 are symmetrical with respect to a vent tube 12, and the ratio of the amount of heat exchanged in the tube bundle 16 to the amount of heat exchanged in the tube bundle 15 is about 15:1. Since there is a difference in the amount of exchanged heat between the two tube bundles 15 and 16 and consequently a greater amount of steam is condensed into water in the tube bundles 16 near the feedwater inlet 2, a greater amount of steam flows into the tube bundle 16 near the feedwater inlet 2. Thus the downwardly directed streams of steam 21 become more powerful than the upwardly directed streams of steam 22, with a result that terminal ends of the gas streams 21 and 22 are concentrated in the central portion of the tube bundle 16 near the feedwater inlet 2 to create a steam stagnating zone 17 in this portion in which steam and noncondensable gas stagnate. It is impossible to remove completely the noncondensable gas accumulated in this stagnating zone 17 through the vent tube 12 interposed between the tube bundle 16 near the feedwater inlet 2 and the tube bundle 15 near the feedwater outlet 3. Thus there is danger of the heat transfer tubes 8 of the tube bundle being corroded by the noncondensable gas in the stagnating zone, particularly in regions near the tube support plates 9 where steam streams especially tend to stagnate.

Corrosion of the heat transfer tubes in portions thereof near the tube support plates is prevented according to the present invention by providing at least one flow guide plate located on the outer periphery side of one of the tube bundles for guiding steam streams toward the vent tube. At least one slit cooperating with the at least one flow guide plate may be formed in the outer marginal portion of the tube bundle. By providing the flow guide plate with or without the slit, it is possible to cause the steam stagnating zone to move to a position which is in the vicinity of the vent tube interposed between the tube bundles, so that the noncondensable gas can be readily removed through the vent tube and corrosion of the heat transfer tubes can be avoided.

The invention will now be described with reference to embodiments thereof illustrated in the accompanying drawings. In FIGS. 3 to 10, parts similar to those shown in FIGS. 1 and 2 are designated by like reference characters.

Figure 3B:
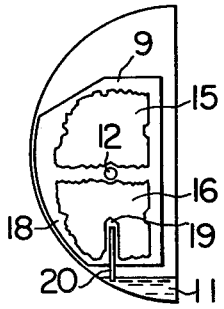
FIG. 3*b* is a sectional view of the line III*b*—III*b* of FIG. 3*a;*
Figure 3A:
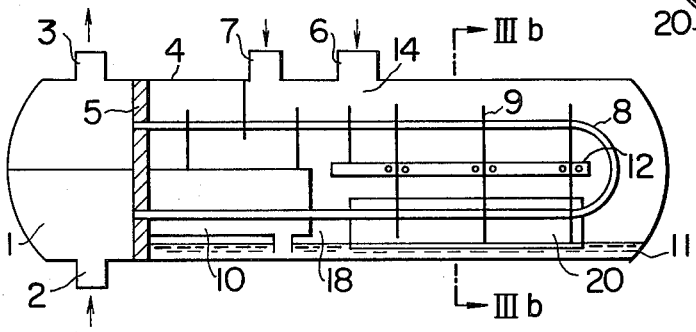
FIG. 3*a* is a sectional view of the twin shell type multitubular heat exchanger comprising one embodiment of the invention.

In FIGS. 3*a* and 3*b*, the numeral 18 designates a condensing zone located near the feedwater inlet 2, the numeral 19 a slit formed in the outer marginal portion of the tube bundle 16 in the condensing zone 18 in a manner to be directed axially and toward the vent tube 12, and the numeral 20 a flow guide plate mounted in the slit 19 and arranged in the same manner as the slit 19. An end portion of the flow guide plate 20 which extends outwardly from the slit 19 is immersed, as a rule, in the water 11 so as to prevent the flow of steam streams between the flow guide plate and the water which would interfere with the flow guiding action of the flow guide plate. In the event that no drain cooler 10 is provided, the flow guide plate 20 extends from a tube plate 5 to portions of the heat transfer tubes 8 which are disposed near their curving parts.

Figure 4A:
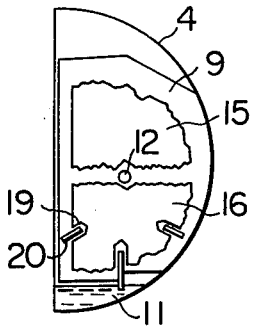
FIGS. 4*a*, 4*b* and 4*c* are sectional views of the twin shell type multitubular heat exchangers comprising other embodiments of the invention.
Figure 4B:
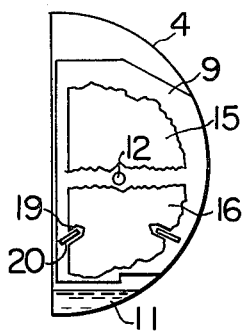
Figure 4C:
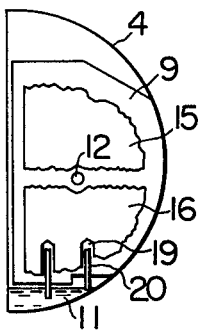
Figure 5A:
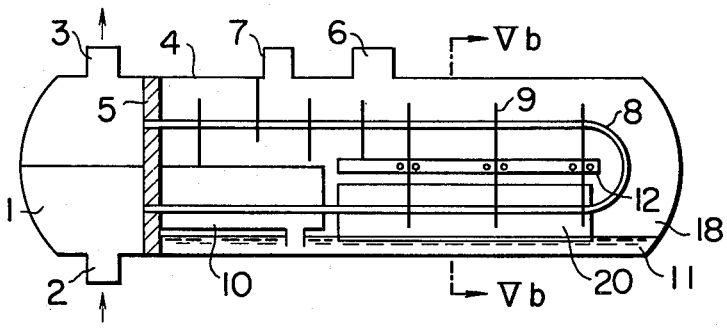
FIG. 5*a* is a sectional view of the single shell type multitubular heat exchanger comprising one embodiment of the invention.
Figure 5B:
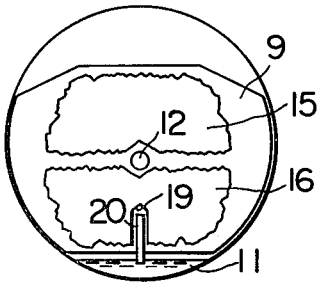
FIG. 5*b* is a sectional view on the line V*b*—V*b* of FIG. 5*a;*
Figure 6A:
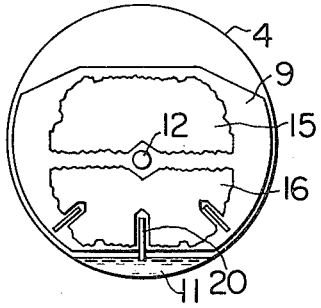
FIGS. 6*a*, 6*b* and 6*c* are sectional views of the single shell type multitubular heat exchangers comprising other embodiments of the invention.
Figure 8A:
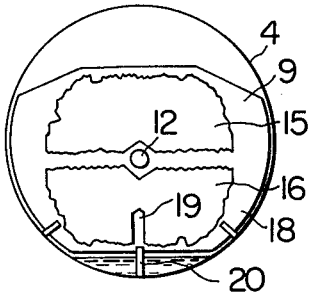
FIGS. 8*a*, 8*b* and 8*c* are sectional views of the single shell type multitubular heat exchangers comprising other embodiments of the invention.
Figure 6B:
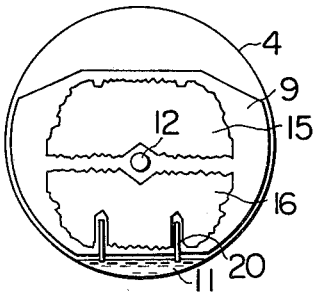
Figure 8B:
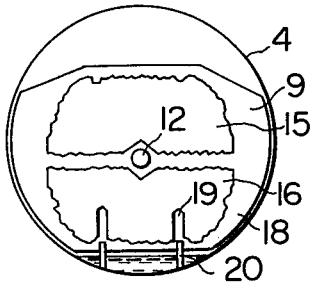
Figure 6C:
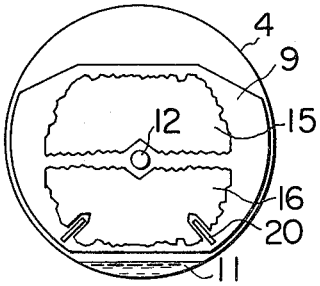
Figure 8C:
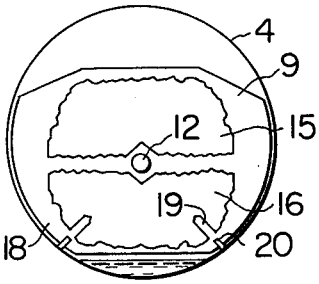

The embodiment shown and described hereinabove is a twin shell type multitubular heat exchanger having one flow guide plate 20. It is to be understood that a plurality of slits 19 and flow guide plates 20 may be provided as shown in FIGS. 4*a*, 4*b* and 4*c*. FIGS. 5*a* and 5*b* show an embodiment which is a single shell type multitubular heat exchanger having one slit 19 and one flow guide plate 20. FIGS. 6*a*, 6*b* and 6*c* show embodiments which are single shell type multitubular heat exchangers having a plurality of slits 19 and flow guide plates 20. In the embodiments shown and described hereinabove, the flow guide plate or plates are advantageously supported by the tube support plates 9.

Figure 7A:
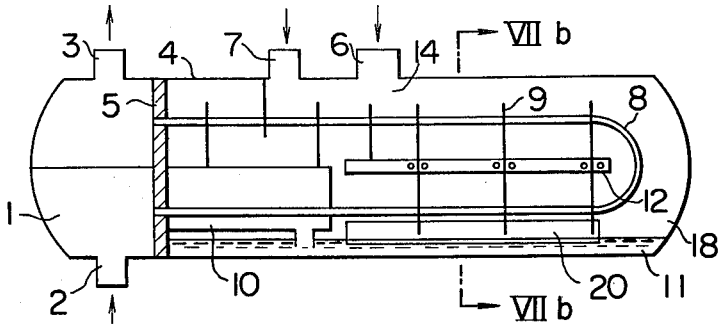
FIG. 7*a* is a sectional view of the single shell type multitubular heat exchanger comprising another embodiment of the invention.
Figure 7B:
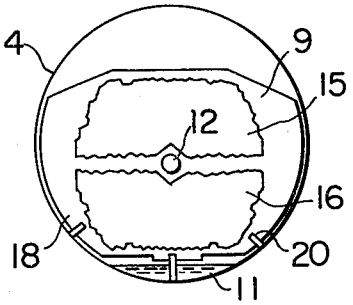
FIG. 7*b* is a sectional view on the line VII*b*—VII*b* of FIG. 7*a;*

In FIGS. 7*a* and 7*b*, there is shown another embodiment wherein a plurality of flow guide plates 20 are mounted on a portion of the inner wall of the shell 4 which is juxtaposed against the outer periphery of the tube bundle 16 located in the condensing zone 18, such flow guide plates 20 being oriented toward the vent tube 12. In the embodiments shown in FIGS. 8*a*, 8*b* and 8*c*, one or a plurality of slits 19 are formed in the outer marginal portion of the tube bundle 16 so that they are juxtaposed against all or some of the flow guide plates 20 mounted on the inner wall of the shell 4 in the same manner as the flow guide plates 20 of the embodiment shown in FIGS. 7*a* and 7*b*.

Figure 9:
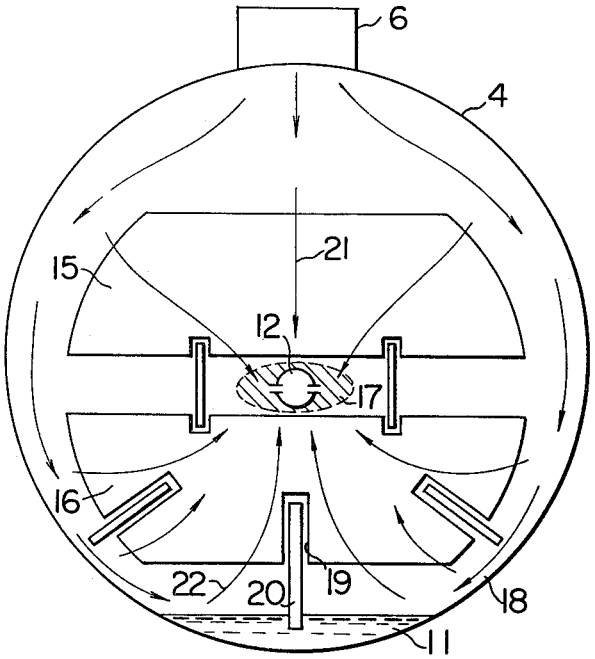
FIG. 9 is a view in explanation of the operation of the heat exchanger according to the invention.
Figure 10A:
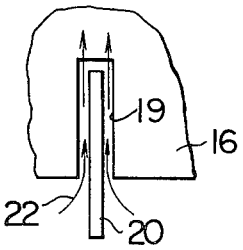
FIGS. 10*a* and 10*b* are views in explanation of the manner in which the flow guide plate of FIG. 9 is mounted.
Figure 10B:
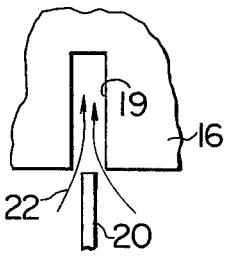

The operation of the invention will now be described. Referring to FIG. 9, the flow guide plates 20 are each inserted in one of the slits 19 formed in the outer marginal portion of the tube bundle 16 disposed near the feedwater inlet and in the condensing zone 18. Since the slits 19 are directed toward the vent tube 12, upwardly flowing steam streams 22 flow upwardly along the flow guide plates 20 toward the vent tube 12. As a result, the steam stagnating zone 17 (see FIG. 2) hitherto formed in the central portion of the tube bundle 16 in a heat exchanger of the prior art is pushed upwardly to a region near the vent tube 12, thereby enabling noncondensable gas to be removed readily from the steam stagnating zone 17 through the vent tube 12. In case a difficulty is encountered in manufacturing the heat exchanger in such a manner that the flow guide plate 20 is inserted in the slit 19 as shown in FIG. 10*a*, the flow guide plate 20 may be mounted in a manner to be juxtaposed against the slit 20 with similar effect as shown in FIG. 10*b*.

From the foregoing description, it will be appreciated that the present invention has the effect of eliminating the stagnation of steam flows in the tube bundle in the condensing zone and venting the noncondensable gas satisfactorily. This is conducive to prevention of corrosion of the heat transfer tubes by the noncondensable gas, improved flow of the gas streams in the tube bundles, and improved performance of the heat exchanger.

What is claimed is:

1. In a feedwater heater comprising a shell, a heating medium inlet formed in said shell, a high temperature tube bundle and a low temperature tube bundle located within said shell and formed by a large number of U-shaped heat transfer tubes for permitting a medium to be heated to flow therethrough so that heat exchange may take place between the medium to be heated and a heating medium introduced into the interior of the shell through the heating medium inlet, and a vent tube interposed between the high temperature tube bundle and the low temperature tube bundle and arranged in the longitudinal direction of the shell for removing noncondensable gas from the interior of the shell, wherein the improvement comprises at least one flow guide plate means located on the outer periphery side of at least the low temperature tube bundle for inducing streams of the heating medium flowing between the shell and the tube bundles to pass on to the vent tube.

2. A feedwater heater as set forth in claim 1, wherein said at least one flow guide plate means is directed toward said vent tube.

3. A feedwater heater as set forth in claim 2, wherein at least one slit cooperating with said at least one flow guide plate means is provided in a manner to open in an outer marginal portion of said low temperature tube handle and extend through the interior of the tube bundle toward the vent tube.

4. A feedwater heater as set forth in claim 3, wherein a portion of said at least one flow guide plate means is disposed within said slit.

5. A feedwater heater comprising a shell, a heating medium inlet formed in said shell, a high temperature tube bundle and a low temperature tube bundle located within said shell and formed by a large number of U-shaped heat transfer tubes for permitting a medium to be heated to flow therethrough so that heat exchange may take place between the medium to be heated and a heating medium introduced into the interior of the shell through the heating medium inlet, and a vent tube interposed between the high temperature tube bundle and the low temperature tube bundle and arranged in the longitudinal direction of the shell for removing noncondensable gas from the interior of the shell, wherein the improvement comprises at least one flow guide plate located on the outer periphery side of at least the low temperature tube bundle for inducing streams of the heating medium flowing between the shell and the tube bundles to pass on to the vent tube.

6. A feedwater heater as set forth in claim 5, wherein at last one slit cooperating with said at least one flow guide plate is provided in a manner to open in an outer marginal portion of said low temperature tube bundle and extending through the interior of the tube bundle toward the vent tube.

7. A feedwater heater as set forth in claim 5, wherein said at least one flow guide plate is directed toward said vent tube.

8. A feedwater heater as set forth in claim 7, wherein there are provided tube support plates for supporting said tube bundles, and said at least one flow guide plate is supported by said tube support plates.

9. A feedwater heater as set forth in claim 7, wherein said at least one flow guide plate is mounted on an inner surface of said shell.

10. A feedwater heater as set forth in claim 7, wherein at least one slit cooperating with said at least one flow guide plate is provided in a manner to open in an outer marginal portion of said low temperature tube bundle and extending through the interior of the tube bundle toward the vent tube.

11. A feedwater heater as set forth in claim 10, wherein a portion of said at least one flow guide plate is disposed within said slit.

12. A feedwater heater as set forth in claim 11, wherein said shell is formed at one end thereof with an inlet water box and an outlet water box for the medium to be heated, and said at least one flow guide plate is mounted for the tube bundle of the heat transfer tubes communicating with said inlet water box for the medium to be heated, which tube bundle is the low temperature tube bundle.

* * * * *